United States Patent [19]

Wietschorke et al.

[11] Patent Number: 4,662,334

[45] Date of Patent: May 5, 1987

[54] VALVE ARRANGEMENT

[75] Inventors: Stephan Wietschorke, Usingen; Gerhard Ruschek, Hattersheim; Andreas Sausner, Frankfurt am Main, all of Fed. Rep. of Germany

[73] Assignee: VDO Adolph Schindling AG, Frankfurt am Main, Fed. Rep. of Germany

[21] Appl. No.: 640,413

[22] Filed: Aug. 13, 1984

[30] Foreign Application Priority Data

Aug. 11, 1983 [DE] Fed. Rep. of Germany ..... 3328949

[51] Int. Cl.[4] ..... F02D 41/00

[52] U.S. Cl. ..... 123/339; 123/585; 251/129.15

[58] Field of Search ..... 123/339, 585; 251/129, 251/129.15

[56] References Cited

U.S. PATENT DOCUMENTS

| | | | |
|---|---|---|---|
| 4,378,766 | 4/1983 | Yamazoe et al. | 123/339 |
| 4,412,517 | 11/1983 | Kobashi et al. | 123/339 |
| 4,438,049 | 3/1984 | Ammons | 123/339 |
| 4,494,517 | 1/1985 | Kratt et al. | 123/339 |

*Primary Examiner*—Andrew M. Dolinar
*Attorney, Agent, or Firm*—Martin A. Farber

[57] ABSTRACT

A valve arrangement for regulating the idling speed of internal combustion engines by controlling the quantity of air on the intake side of an intake manifold 1 leading to the internal combustion engine. The valve arrangement has an electromechanical control member which has a solenoid 7 by which a closure member 4 can be moved, via a control element, in opposition to the force of a return spring 8. The closure member 4 is movable relative to the control element between a position of rest and an operating position and, in the position of rest, is in a well-defined partially open position of the valve passage.

14 Claims, 2 Drawing Figures

VALVE ARRANGEMENT

BACKGROUND OF THE INVENTION

The invention relates to a valve arrangement for regulating the idling speed of internal combustion engines by controlling the quantity of air on the intake side of an intake manifold leading to the internal combustion engine, having an electromechanical control member which has a solenoid by which a closure member can be moved via a control element against the force of a return spring.

Such valve arrangements serve to keep the idling rpm of the engine as low as possible but at the same time also regulate it in such a manner that, in case of additional loads such as result, for instance, from auxiliary units in a vehicle, the idling speed does not drop down to such a point that the engine stalls. For this purpose, the solenoid is acted on by a control current which is formed, inter alia, as a function of the actual rpm and which effects such a displacement of the closure member that the actual speed reaches a predetermined desired speed substantially independently of disturbing variables.

When the solenoid is without current, the control member and, together with it, the closure member are moved by the return spring into either the fully open or the fully closed position. This occurs when no current acts on the solenoid aside from the automotive operation. However, this may also take place as a result of a defect by which the current supply to the solenoid is interrupted.

In the traditional valve arrangements this has the result that the engine operates either with a maximum idling speed or with a minimum idling speed with the danger of stalling.

The object of the invention is, therefore, to create a valve arrangement of the type described above which, by simple means, assures an idling speed which is as low as possible but at all times sufficiently high to prevent stalling of the engine in the event of a failure of the solenoid.

SUMMARY OF THE INVENTION

In accordance with the invention, the closure member (4, 4') is movable relative to the control element between a position of rest and an operating position and, in its position of rest, is in a well-defined partially open position of the valve passage.

Upon failure of the current through the solenoid, the parts of the valve arrangement automatically move from an operating position into their position of rest. Since in the position of rest the closure member is located in a well-defined, partially open, position of the valve passage which is as small as possible but suffices, even upon additional loading by additional units, to assure, at all times, dependable operation of the engine, satisfactory idling operation is assured.

In one simple development, the control element is a push rod (6) which is connected with the movable armature (9) of the solenoid (7). The possibility of relative movement of the closure member with respect to the control element can be obtained in the manner that the closure member (4, 4') is arranged displaceably on the push rod (6). No special guides are thus necessary for the closure member.

The push rod (6) is preferably urged in the closed direction by the return spring (8).

In order to hold the closure member in a well defined position on the push rod upon intact feeding of current to the solenoid, the closure member (4, 4') can, in the operating position, be held resting against a stop (10) arranged on the push rod (6).

The stroke of the push rod (6) in the direction of closing can be limited by a stop (17).

In one simple embodiment, the closure member (4) can be acted on in the direction of closing by a compression spring (11) and, in a partially open position, rest against a stop (16) which prevents further closing. In this way, when the solenoid is without current, the push rod is displaced in the closing direction by the return spring until the closure member comes against this stop. The return spring, which is of greater force than the compression spring, then, to be sure, still moves the push rod—but not the closure member—further in the direction of closing until the push rod also comes against its stop (17).

The stop (16) for the closure member is preferably one lever arm (15) of a two-arm lever which is swingable about a pivot pin (**14*a*), its second lever arm (13) being adapted to be acted on by the push rod (6**). This has the advantage that when the solenoid is without current, closing movement of the closure member is possible, only up to the partially open position. When the flow of current is intact the closure member can move unimpeded until it is seated or almost seated on the valve seat of the valve arrangement.

In another embodiment, the closure member (4') can, in the position of rest, be held against a stop (18) arranged on the push rod (6) and be thus located in the correct partially open position.

In order to reliably hold the closure member either in its operating position or in its position of rest, the closure member (4') can be connected via a snap spring (19) with the stop (18) and be brought by the snap spring, on one side of the point of snap of the snap spring, against the stop (18) for the position of rest and, on the other side of the snap point, against the stop (10) for the operating position.

Automatic movement of the closure member out of the operating position into the position of rest is obtained in simple fashion in the manner that the closure member (4') can strike against the valve seat (5) of the valve arrangement and the push rod (6) moved to such an extent in the direction of closing that the point of snap of the snap spring (19) can be passed and the closure member (4') can be moved against the stop (18) for the position of rest. Here the force of the return spring which acts in closing direction is greater than the force of the snap spring.

Automatic movement of the closure member out of the position of rest into the operating position can be obtained in the manner that the closure member (4') can be moved out of the partially open position in the direction of opening against a spring force which is greater than the application force of the closure member (4') against the stop (18) for the position of rest. If the operating position is to be assumed from the position of rest after current has been supplied to the solenoid, the solenoid pulls the push rod in the opening direction until the snap point has been passed. The closure member, due to the large spring force acting on it, can only participate in the movement in opening direction when it rests against the stop of the operating position since then the control force of the solenoid is greater than the load exerted in closing direction by the springs on the closure member.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
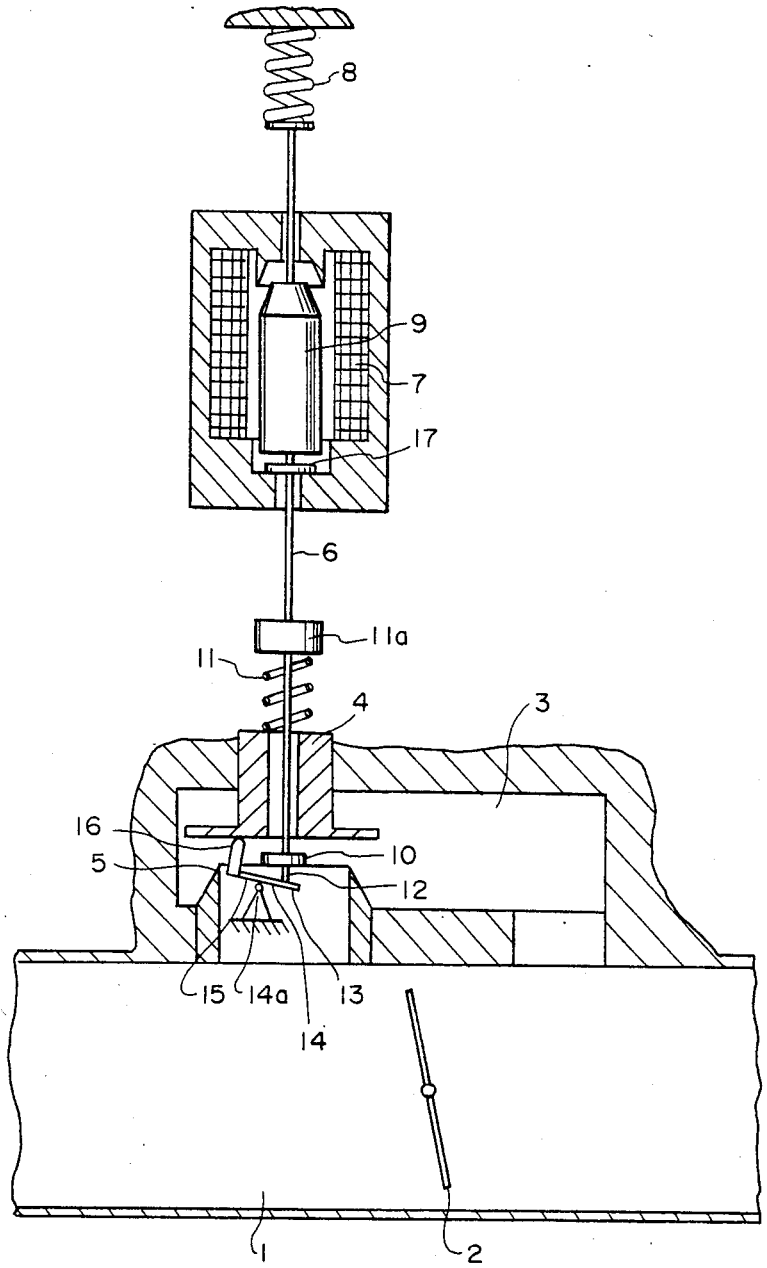
FIG. 1 is a first illustrative embodiment in longitudinal section of a valve arrangement in accordance with the invention.

Both of the figures show an intake manifold 1 which leads to an internal combustion engine (not shown on the right side), and within which a throttle valve 2 is rotatably arranged. Via a bypass 3 of the manifold, the region in front (upstream) of the throttle valve 2 (the inlet side of the manifold, left side of the latter) can communicate with the region behind (downstream) of the throttle valve 2 (the engine intake side of the manifold, right side of the latter).

The bypass 3 (also called valve passage) can be closed to a greater or lesser extent by a valve arrangement by which a closure member 4 or 4' can be moved towards a valve seat 5.

When the closure member 4 or 4' is seated on the valve seat 5, no air can flow through the bypass from the atmosphere side (the inlet side on the left) to the engine intake side of the intake manifold 1.

The closure member 4 or 4' is axially displaceable between a position of rest (FIGS. 1 and 2) and an operating position (not shown) on a control element, namely a push rod 6 which carries an armature 9 of a solenoid 7 and can be biased into closing direction (downwardly) by a return spring 8.

When current flows through the solenoid 7, the push rod 6 is moved to a greater or lesser extent in the opening direction against the force of the return spring 8. In the operating position, which is assumed when current flows through the solenoid 7, the closure member 4 or 4' is pushed in a direction towards the valve seat and held resting against a stop 10 which is fixed on the push rod 6.

In FIG. 1 this is done by a compression spring 11 which presses down on the closure member 4 and rests against an abutment 11*a* secured to the push rod 6.

The bottom end 12 of the push rod 6 is a free end 12 which can removably abut a lever arm 13 of a double-armed lever 14, the lever being swingable about a stationary pivot point or pivot pin 14*a*. The other lever arm 15 of this lever 14 is provided with a stop 16 against which the closure member 4 can come to rest.

The lever 14 with its lever arms 13 and 15 and stop 16 as well as the free end 12 of the push rod 6 are so arranged with respect to each other that when the intact solenoid 7 is traversed by current in the operating condition, and the closure member 4 rests against the stop 10, then the free end 12 of the push rod 6 does not abut the lever arm 13. In this way the closure member 4 can come close to engagement against the valve seat 5. Engagement with the valve seat 5 can occur with a higher relative arrangement of the valve seat 5. Further opening movement of the closure member 4 away from the valve seat 5 can be controlled by the current through the solenoid 7 for normal idling regulation in this operating condition.

Upon further movement of the push rod 6 in the closing direction, as is the case due to the return spring 8 when the solenoid 7 is without current, the free end 12 of the push rod 6 strikes against the lever arm 13 so that the arm 13 swings in the direction of closing. At the same time, the other lever arm 15 swings in the direction of opening and, via its stop 16, holds the closure member 4 in a partially open position away from the valve seat 5. Since the force of the return spring 8 is greater than the force of the compression spring 11, this rest position as shown in FIG. 1 is stably maintained when the solenoid 7 is without current.

In order to define this position of the push rod 6, the rod has another stop 17, by which its movement in the closing direction is limited by abutment against a stationary member, e.g. a shoulder of the solenoid housing.

Figure 2:
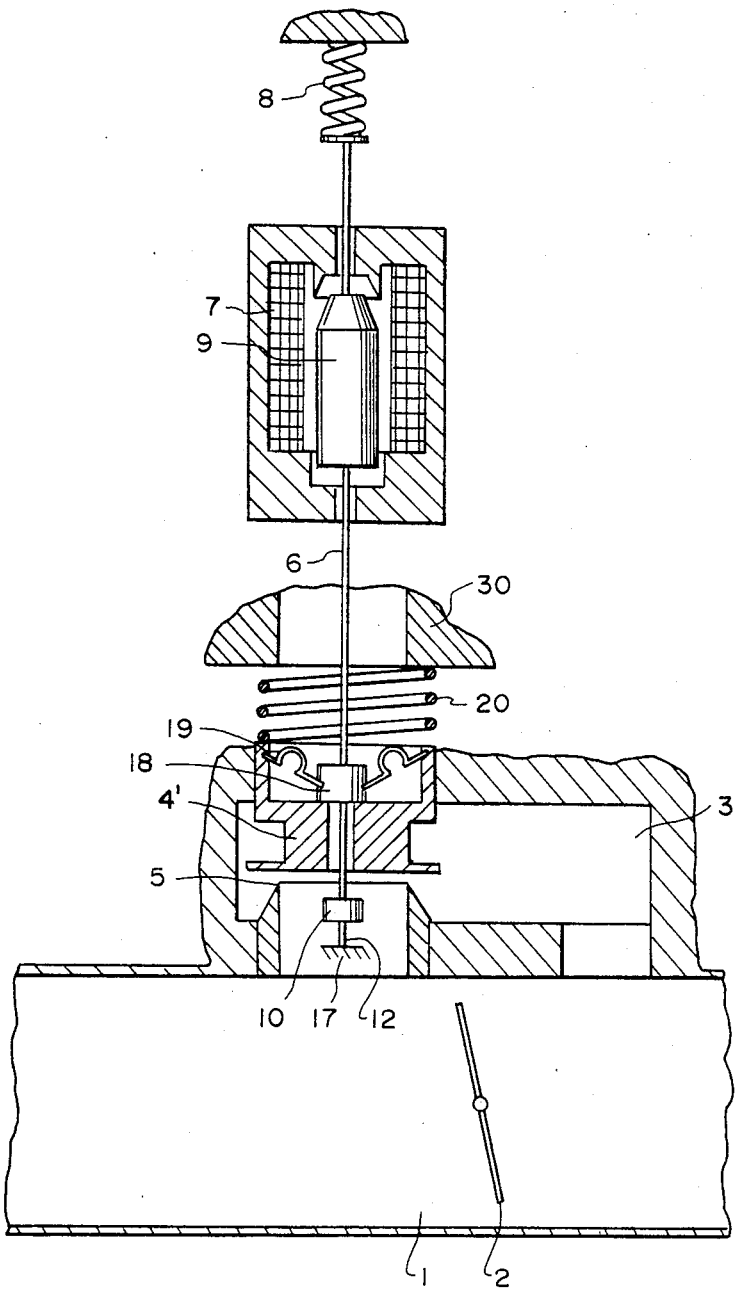
FIG. 2 is a second illustrative embodiment in longitudinal section of a valve arrangement in accordance with the invention.

In FIG. 2, the closure member 4' is displaceable on the push rod 6 between the stop 10 and another stop 18 arranged on the push rod 6. A snap spring arranged between the stop 18 and the closure member 4' moves the closure member 4' against either the stop 10 or the stop 18.

Furthermore, a fixedly supported compression spring 20 is mounted against a stationary support 30 and the top of the closure member 4'. The compression spring 20 has the characteristic of having greater force than the snap 19 and engages in closing direction against the top of the closure member 4'. In the position of rest of the closure member 4' corresponding to a partial opening of the bypass 3 by means of the closure member 4' which is shown in FIG. 2, the compression spring is in a neutral non-tensioned unstressed condition.

In this partially open position (the rest position) which is assumed when the solenoid 7 is without current, the push rod 6 is displaced by the return spring 8 in the closing direction until its free end 12 comes against against a fixed stop 17. The closure member 4' is held against the stop 18 by the snap spring 19.

If current now flows through the solenoid 7 then the push rod 6 moves upwardly in the opening direction initially lifting the closure member 4' via the spring 19. Due to the compression spring 20, which becomes further compressed, and having a spring force which is greater than the application force, via the spring 19, of the closure member 4' against the stop 18, acts as stop, the closure member 4' is held in a partially open position until the stop 18 has moved away from the closure member 4' to such an extent that the snap spring 19 snaps and the closure member 4' is now brought against the stop 10 in its operating position (not shown).

Further movement of the closure member 4' into open positions against the force of the compression spring 20 for normal idling regulation is now readily possible since the force of the solenoid 7 is greater than the force of the compression spring 20 and the return spring 8.

When no current again flows in the solenoid 7, compression spring 20 and return spring 8, initially together and then only the return spring 8, move the closure member 4' in the closing direction until the closure member 4' rests against the valve seat 5. The return spring 8 produces further movement of the push rod 6 until the end 12 of the latter comes against the stop 17 as illustrated in FIG. 2 in the rest position. Prior to this, however, the snap point of the snap spring 19 is exceeded so that the snap spring 19 moves the closure member 4' against the stop 18.

In this partially open position as well as in the partially open position shown in FIG. 1, there is assured, through the bypass 3, a flow of air which is as small as possible but nevertheless assures idling operation even when the engine is loaded by additional units.

I claim:

1. In a valve arrangement for regulating the idling speed of an internal combustion engine by controlling the quantity of air passing from an inlet side to an engine intake side of an intake manifold leading to the internal combustion engine, having an electromechanical control member which has a solenoid for moving a control element for moving a single closure member against the force of a return spring, the improvement comprising:

a valve passage connecting said inlet side to said engine intake side of said intake manifold, said closure member is movably disposed with respect to said valve passage so as to change the condition of opening of said valve passage, and said closure member is movable relative to the control element between a position of rest and an operating position of said closure member, and means for holding said closure member in its position of rest, in a well-defined partially open condition of the valve passage, said closure member is displaceably arranged on said control element.

2. In a valve arrangement for regulating the idling speed of an internal combustion engine by controlling the quantity of air passing from an inlet side to an engine intake side of an intake manifold leading to the internal combustion engine, having an electromechanical control member which has a solenoid for moving a single closure member via a control element against the force of a return spring, the improvement comprising:

a valve passage connecting said inlet side to said engine intake side of said intake manifold, said closure member is movably disposed with respect to said valve passage so as to change the condition of opening of said valve passage, and said closure member is movable relative to the control element between a position of rest and an operating position of said closure member, means for holding said closure member in its position of rest, in a well-defined partially open condition of the valve passage, said solenoid has a moveable armature, said control element comprises a push rod connected to said movable armature, and said closure member is displaceably arranged on said push rod.

3. The valve arrangement according to claim 2, wherein said return spring is arranged for biasing said push rod in a closing direction.

4. The valve arrangement according to claim 3, further comprising a stop fixedly arranged on said push rod, the closure member in its operating position is held resting against the stop.

5. The valve arrangement according to claim 4, further comprising stop means on said push rod for limiting the stroke of the push rod in the direction of closing.

6. The valve arrangement according to claim 2, wherein said position of rest occurs when said solenoid is unenergized and said operating position occurs in an energized condition of said solenoid.

7. The valve arrangement according to claim 2, wherein said well-defined partially open condition of the valve passage in said rest position is as small as possible yet sufficient to insure dependable operation of the engine.

8. The valve arrangement according to claim 2, further comprising spring means on said push rod for biasing the closure member in the direction of closing.

9. The valve arrangement according to claim 2, wherein said closure member is movable relative to the control element from beyond the position of rest through the position of rest to the operating position of the closure member.

10. The valve arrangement according to claim 2, wherein said closure member is movable relative to the control element and from an opening of said valve passage larger than that of the position of rest to an opening smaller than that of the rest position of the closure member.

11. In a valve arrangement for regulating the idling speed of an internal combustion engine by controlling the quantity of air passing from an inlet side to an engine intake side of an intake manifold leading to the internal combustion engine, having an electromechanical control member which has a solenoid for moving a closure member via a control element against the force of a return spring, the improvement comprising:

a valve passage connecting said inlet side to said engine intake side of said intake manifold, and wherein said closure member is movably disposed with respect to said valve passage so as to change the condition of opening of said valve passage, and said closure member is movable relative to the control element between a position of rest and an operating position of said closure member, the valve arrangement further comprising means for holding said closure member in its position of rest, in a well-defined partially open condition of the valve passage, and wherein said solenoid has a movable armature, said control element comprises a push rod connected to said movable armature, said return spring is arranged for biasing said push rod in a closing direction, there being a stop fixedly arranged on said push rod, and wherein the closure member in its operating position is held resting against the stop, the valve arrangement further comprising stop means on said push rod for limiting the stroke of the push rod in the direction of closing, means comprising a compression spring on said push rod for biasing the closure member in the direction of closing; and wherein said holding means includes a second stop; and said closure member in said partially open condition of the valve passage, rests against said second stop the latter which prevents further closing of the valve passage by said closure member.

12. The valve arrangement according to claim 11, further wherein said holding means includes, a two-arm lever swingable about a stationary pivot pin, said lever including, a first lever arm including said second stop, and a second lever arm in the stroke of and engageable by said push rod.

13. The valve arrangement according to claim 11, wherein said position of rest occurs when said solenoid is unenergized and said operating position occurs in an energized condition of said solenoid.

14. The valve arrangement according to claim 11, wherein said well-defined partially open condition of the valve passage in said rest position is as small as possible yet sufficient to insure dependable operation of the engine.

* * * * *